United States Patent [19]

Serex et al.

[11] 4,199,317

[45] Apr. 22, 1980

[54] PRINTING PROCESS

[75] Inventors: Charles Serex, Geneva, Switzerland; Robert Decombe, Ferney-Voltaire, France

[73] Assignee: Sublistatic Holding SA, Glaris, Switzerland

[21] Appl. No.: 528,862

[22] Filed: Dec. 2, 1974

[30] Foreign Application Priority Data

Dec. 13, 1973 [CH] Switzerland ..... 17439/73

[51] Int. Cl.[2] ..... D06P 5/00; D06P 5/20; D06P 5/22

[52] U.S. Cl. ..... 8/2.5 A; 8/2.5 R

[58] Field of Search ..... 8/2.5 R, 2.5 A, 176

[56] References Cited

U.S. PATENT DOCUMENTS

| | | | |
|---|---|---|---|
| 3,232,692 | 2/1966 | Wilhelm et al. | 8/18 |
| 3,708,261 | 1/1973 | Kasper et al. | 8/116.3 |
| 3,768,280 | 10/1973 | Konnegiesser et al. | 68/5 P |
| 3,782,896 | 1/1974 | Defago et al. | 8/2.5 |
| 4,072,462 | 2/1978 | Vellins et al. | 8/2.5 A |
| 4,088,440 | 5/1978 | Leimbacher et al. | 8/2.5 A |

FOREIGN PATENT DOCUMENTS

| | | | |
|---|---|---|---|
| 639192 | 4/1962 | Canada | 8/2.5 UX |
| 1957262 | 9/1970 | Fed. Rep. of Germany | 8/2.5 A UX |
| 2045465 | 6/1971 | Fed. Rep. of Germany | 8/2.5 UX |
| 2418519 | 11/1974 | Fed. Rep. of Germany | 8/2.5 A |
| 1591909 | 6/1970 | France | 8/2.5 UX |
| 460695 | 4/1968 | Switzerland | 8/2.5 A |

OTHER PUBLICATIONS

American Dyestuff Reporter, 6-5-67, pp. 31-35.

*Primary Examiner*—Stanford M. Levin

*Attorney, Agent, or Firm*—Wenderoth, Lind & Ponack

[57] ABSTRACT

The invention provides an improvement in the known dry thermoprinting process making it possible to employ the process to dye or print natural fibers or mixtures of natural and synthetic fibers. Textile material consisting of natural fibers or of a mixture of natural and synthetic fibers is impregnated with a precondensate of a thermosetting resin. The thus impregnated material is then dyed or printed by the dry thermoprinting process, the curing of the resin taking place during the transfer of the dyestuff.

6 Claims, No Drawings

PRINTING PROCESS

Known dry thermoprinting processes make it possible to dye and especially to print synthetic materials, mainly textiles made of linear polyesters, also those made of polyamides and even those made of polyacrylonitrile. On the other hand, it is not possible, by means of these processes, either to dye or to print natural fibres or, in general terms, materials devoid of affinity for sublimable dyestuffs.

This is why, for the purpose of overcoming the abovementioned disadvantage and of achieving a process for dyeing textile materials consisting wholly or partially of fibres which do not have any affinity for sublimable dyestuffs, French Pat. No. 1,591,909 first (that is to say prior to the thermoprinting operation) impregnates the fibres devoid of affinity with a polymer such as those in which the sublimable dyestuffs are soluble (polyamides, polyurethanes, acrylic and vinyl resins, polyesters and the like). These resins all have the disadvantage of changing the properties of the fibres which they impregnate and mainly their handle. This also applies to epoxy resins and to the process described in German Patent Application No. 2,045,465.

Furthermore, attempts have been made, without success, to transfer sublimable dyestuffs onto cotton sized with a polycondensate of thermoset resins which impart to it water-repellent or crease-resistant properties and/or resistance to weathering and even to wet treatments; the prints obtained were always very pale and not very fast.

The present invention makes it possible to overcome the disadvantages indicated above. It relates to a process for dyeing and/or printing natural or regenerated fibres, mainly cellulosic fibres, by dry transfer of dyestuffs, this process making it possible to obtain strong shades which possess good fastness to wet treatments.

The subject of the present invention is thus a process for dyeing textile materials, according to which the prints, preferably multi-colored, produced by means of sublimable or vaporisable dyestuffs, fixed, preferably in accordance with a particular design, to an inert carrier such as a sheet or strip of paper, are transferred to the material to be dyed by contact and by vaporisation of the said dyestuffs.

The process of the present invention is characterised in that it is applied to textile materials consisting wholly or only partially of fibres which have only little or no affinity for sublimable dyestuffs and which, prior to their printing, are impregnated with a precondensate of a thermosetting resin, the curing of the latter being carried out during the transfer of the dyestuffs.

Known starting materials are thus used in this process; thus, the temporary carriers, that is to say the transfer papers used, are those which are available commercially and are described, for example, in French Pat. Nos. 1,223,330, 1,575,069 and 2,129,481 and in Belgian Pat. No. 761,618. French Pat. No. 2,129,481 discloses, inter alia, the employment of the dyestuffs 1,4-dimethylamino-anthraquinone, chlorinated or brominated-1,5-diamino-4,8-dihydroxy-anthraquin-one, 3-hydroxyquinophthalone, and 2-hydroxy-5-methyl-4'-acetylamino-phenyl-azobenzene. French Patent 1,575,069 discloses, inter alia, the employment of the dyestuff 5-butyryl-aminoisothiazolanthrone. French Pat. No. 1,223,330 discloses, inter alia, the employment of the dyestuff 1-aminoazobenzene-phenol (Artisile Yellow RGFL—See Color Index, Third Edition, Vol. 5, No. 26070). The precondensates of thermosetting resins are also well known. They are the precondensates used hitherto in industry for impregnating cellulosic fibres to which it is desired to impart a so-called "wash and wear" finish or a cease-resistant finish by formation (curing) of the resin on the fibre. These precondensates are generally methylol derivatives of amides which can react with the fibre, and in particular dimethylol derivatives of cyclic nitrogen-containing compounds. By way of example, there may be mentioned N-methylol resins, for example methylol-melamines, methylol-ureas and their ethers, as well as methylol derivatives of an amide such as those of acrylamide and itaconic acid amide, that of malonic acid or, for example, N-hydroxymethylacetyl-thioacetamide or the following compounds:

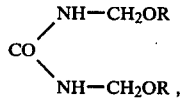

R being hydrogen or a methyl or ethyl group.

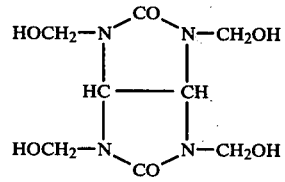

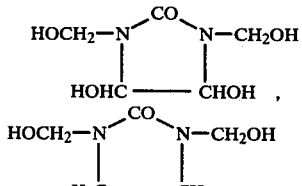

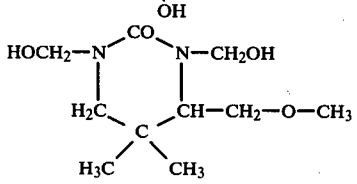

These precondensates, which are generally available commercially in the form of a powder, solutions or dispersions and even emulsions, are applied to the textile in accordance with known methods such as impregnation processes, padding, spraying, sprinkling and the like.

The curing of the abovementioned precondensates takes place according to the present invention at the same time as the transfer of the dyestuffs, that is to say when the textile is being heated in contact with the transfer paper. It is thus advisable to carry out the operation of transferring the dyestuff or dyestuffs onto a textile material which possesses not only the precondensates characterising the present invention but also catalysts which promote the condensation of the resin. These catalysts are well known to those skilled in the art. There are acid catalysts and basic catalysts. In the case of cotton, catalysts of the Lewis acid type are preferably used and are applied before or after, but generally at the same time as the precondensate. Amongst the Lewis acids usually employed in the padding treatments, there may be mentioned aluminium chloride, zinc chloride or magnesium chloride hexahydrate, aluminium nitrate or zinc nitrate, zinc fluoroborate or sodium fluoroborate and the like; they can optionally be buffered with an organic acid such as, for example, lactic acid.

The transfer of the dyestuffs is carried out in the usual way at 180°-220° C. for 15 to 100 seconds on apparatuses (presses or calenders) intended for this operation. During the transfer of the dyestuff or dyestuffs, the resin (deposited beforehand on the textile in the form of a precondensate) cures; once the transfer is complete, a fast dyeing or print is obtained which also possesses all the properties of resin-based finishes.

It is surprising that, by means of the process of the present invention, it is possible to obtain fast prints on natural fibres, and especially on cellulosic fibres such as cotton and staple fibre but also linen, jute and ramie. Particularly valuable results are obtained on mixtures of natural fibres and synthetic fibres such as cotton/-polyester and cotton/polyamide mixtures or wool/-polyacrylonitrile mixtures.

The process according to the invention can advantageously be carried out on substrates comprising not only a thermosetting resin but also polymers possessing affinity for the dyestuffs to be transferred or mixtures which are precursors of such polymers and which can preferably be polymerised or crosslinked under hot conditions, at the same time as the transfer operation. They can be acrylates, polyamides, polymethacrylates or polyesters, polysiloxane, polystyrene or epoxides such as diglycidyl ether and triglycidyl cyanurate or isocyanurate as well as the products resulting from the reaction of epoxy compounds with thiourea, thiourea derivatives or rhodanides, for example the product resulting from the reaction of triglycidyl cyanurate or isocyanurate with thiourea.

In the following non-limiting examples, the parts and percentages given are expressed by weight, unless otherwise indicated, and the temperatures are expressed in degrees centigrade.

EXAMPLE No. 1

Preparation of the transfer paper

A strip of paper is printed by photogravure using inks prepared from one part of dyestuff per ten parts of ethylcellulose (ETHOCEL E 7) and 85 parts of a mixture of 50% ethanol and 50% methyl ethyl ketone. Their viscosity is the adjusted, before printing, by adding isopropyl alcohol.

The dyestuffs used are the yellow dyestuffs of the formula

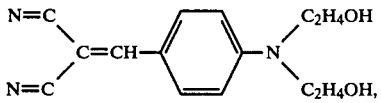

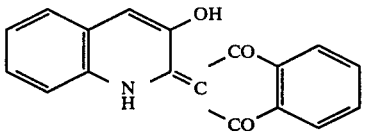

and

-continued

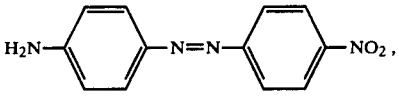

the red dyestuffs of the formula

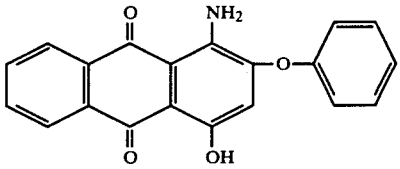

and

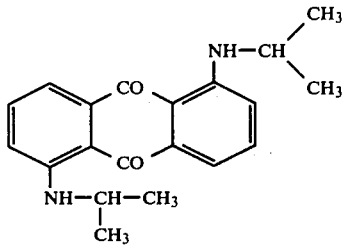

the blue dyestuffs of the formula

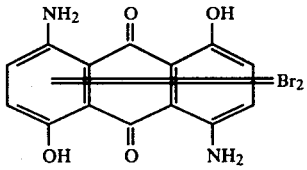

and

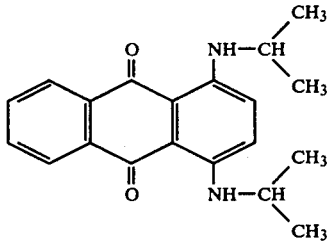

and the violet dyestuff of the formula

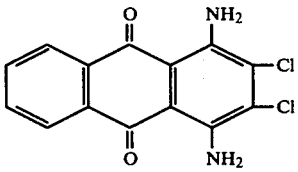

A polyester/cotton woven fabric of the ratteen type, which consists of 65% of polyester and 35% of cotton in the form of an intimate mixture and which has been bleached and mercerised, is padded in an aqueous bath comprising 70 g/l of dimethylolurea (DMU), 10 g/l of the methylol derivative of stearic acid amide and 10 g/l of a Lewis acid ($Mg_2Cl_2.6H_2O$), squeezing to 80% pick-up.

The woven fabric thus padded is dried at 90° C.

Thereafter, this woven fabric is placed in contact with a transfer paper prepared as indicated above, and the combination is heated on a calender heated to 200° C.; contact is maintained for 50 seconds.

Transfer of the dyestuffs and condensation of the resin thus take place simultaneously. The prints obtained are bright and sharp and possess satisfactory fastness to washing.

No subsequent treatment is necessary.

EXAMPLE No. 2

A woven fabric similar to that of Example 1 is padded, squeezing to 80% pick-up, in a bath comprising 100 g/l of dimethylol-propylene-urea (DMPU), 20 g/l of a non-ionic emulsion of polyethylene, 10 g/l of $MgCl_2.6H_2O$ and 20 g/l of a solution containing 1 $cm^3$ of lactic acid.

Thereafter, this woven fabric is dried at 100° C. and then printed using a paper as described in Example No. 1. The prints obtained are also sharp and bright; the handle is not greatly affected the fastness to washing is satisfactory.

EXAMPLE No. 3

The operations described in Example No. 1 are repeated but the 70 g/l of dimethylol-urea in the padding bath are replaced by 120 g/l of dimethyloldihydroxyethylene-urea and the concentration of Lewis acid is doubled.

Drying is effected at 100° C. The prints obtained possess the same properties as those obtained in Example No. 1

EXAMPLE No. 4

The operations described in Example No. 1 are repeated but the 70 g/l of dimethylol-urea in the padding bath are replaced by 100 g/l of dimethylol-5-oxypropylene-urea and the concentration of Lewis acid is doubled.

Drying is effected at 100° C. The prints obtained possess the same properties as those obtained in Example No. 1

EXAMPLE No. 5

The operations described in Example No. 1 are repeated but the 70 g/l of dimethylol-urea in the padding bath are replaced by 110 g/l of N,N'-dimethyl-itaconamide and 20 g/l of a solution of hydrogen peroxide and zinc borofluoride are added. Drying is effected at 90° C. The prints obtained possess the same properties as those obtained in Example No. 1

EXAMPLE No. 6

The operations described in Example No. 1 are repeated but the 70 g/l of dimethylol-urea in the padding bath are replaced by 120 g/l of dimethylol-ethylene-urea.

The prints obtained possess the same properties as those obtained in Example No. 1.

EXAMPLE No. 7

20 g of triglycidyl cyanurate are dissolved in ½ liter of water at 80° C. The solution is allowed to cool to approximately 40° C. and 7 g of thiourea are then added. After 5 to 10 minutes, the volume is made up to 1 liter with an aqueous solution of 240 g/l of dimethylol-ethylene-urea, 30 g/l of TURPEX NP (Pfersee), which is a softener which is fast to washing, and 40 g/l of a Lewis acid.

A woven fabric consisting of 65/35 cotton/polyester (intimate mixture) is padded with the above dispersion in such a way as to squeeze to 80% pick-up.

The woven fabric thus padded is dried at a temperature below 110° C. (temperature of the woven fabric). Transfer onto the woven fabric obtained is effected as in Example 1 and a strong print, tone on tone, which is fast to rubbing and to washing is obtained.

EXAMPLE No. 8

40 parts of hexamethylol-triazine,
30 parts of dimethylol-urea,
10 parts of methylol-acrylamide,
30 parts of an aqueous emulsion of polybutyl methacrylate,
10 parts of calcium acrylate, and
10 parts of magnesium chloride hexahydrate are dissolved in 500 parts of water and then the volume is made up to 1,000 parts with water.

Using the dispersion obtained, a woven fabric consisting of 50/50 cotton/polyester is padded in such a way as to squeeze to 80% pick-up.

The woven fabric thus padded is dried at a temperature below 110° C. (temperature of the woven fabric). Transfer onto the woven fabric obtained is effected as in Example 1 and a strong print, tone on tone, which is fast to rubbing and to washing is obtained.

EXAMPLE No. 9

The procedure of Example No. 8 is followed, but
60 parts of hexamethylol-triazine,
20 parts of glyoxal-urea and
30 parts of an emulsion of polymethyl methacrylate are dissolved in 500 parts of water and then the volume is made up to 1,000 parts with water.

An excellent result is also obtained when transfer is effected onto a woven fabric treated with the above emulsion.

In order to have a waterproof finish, the procedure of Example 8 is followed but a suspension of
30 parts of hexamethylol-triazine
30 parts of methylol-substituted ethylene-urea,
60 parts of the methylol derivative of stearic acid amide and
10 parts of aluminium sulphate in 1,000 parts of water is used.

A fast print combined with a crease-resistant finish is also obtained by replacing the 60 parts of the methylol derivative of stearic acid amide in the preceding paragraph by 60 parts of PHOBOTEX$^R$ FTC (CIBA-GEIGY).

EXAMPLE No. 10

The procedure of Example 8 is followed, but a suspension of
30 parts of hexamethylol-triazine,
30 parts of methylol-substituted ethylene-urea,
60 parts of the methylol derivative of stearic acid amide and
10 parts of aluminium sulphate in 1,000 parts of water, to which 10 parts of an aqueous suspension containing 15% of a polysiloxane have been added, is used.

After transfer, a bright print, tone on tone, is obtained which is fast to washing and the handle of which is markedly softer than in Examples 1 and 8.

Transfer can be effected for 40 seconds at 210° C. with equally good results.

EXAMPLE No. 11

The procedure of Example No. 8 is followed, but using 20 parts of hexamethylol-melamine,
20 parts of dimethylol-urea,
20 parts of butyl methacrylate in the form of an emulsion,
30 parts of an aqueous emulsion containing 46–50% of polybutadiene/acrylonitrile and
10 parts of $MgCl_2.6H_2O$
in 1,000 parts of water, or using
40 parts of hexamethylol-melamine,
30 parts of polymethacrylate in the form of an emulsion,
20 parts of an emulsion containing 46% of polybutadiene/acrylonitrile/styrene in water and
10 parts of zinc nitrate
in 1,000 parts of water.

After transfer (45 seconds at 205° C.), a strong print which is fast both to rubbing and to washing is obtained.

EXAMPLE No. 12

The procedure of Example No. 8 is followed, but using 50 parts of hexamethylol-urea,
30 parts of ethylene-urea,
20 parts of a suspension of polysiloxane,
10 parts of magnesium chloride hexahydrate and
10 parts of an epoxy-amine.

After transfer, a bright print, tone on tone, is obtained which is fast to washing and the handle of which is markedly softer than that of the prints obtained according to Examples 1 and 8.

Transfer can be effected for 40 seconds at 210° C. with equally good results.

We claim:

1. In a process for the dry thermoprinting of textile materials which comprises bringing into face-to-face contact (a) a flexible paper temporary carrier sheet bearing on the textile material contacting face thereof at least one sublimable disperse transfer dyestuff, and (b) a textile material, subjecting the carrier sheet and textile material, while in contact, to heating to cause sublimation transfer of dyestuff from the carrier sheet to the textile material, and separating the textile material from the carrier sheet, the improvement according to which (1) the textile material consists of natural fibers which have little or no affinity for sublimable dyestuff or mixtures of such natural fibers with synthetic fibers, (2) the textile material, prior to contact with the carrier sheet, is impregnated with at least one precondensate of N-methylol -melamine resin or N-methylol-urea resin which is cyclic or non-cyclic and ethers thereof, said precondensate containing a Lewis acid catalyst, (3) the curing of the N-methylol resin is effected during the transfer of dyestuff to the textile material, and (4) the sublimable dyestuff is selected from the group consisting of 1,4-dimethylamino-anthraquinone,
chlorinated 1,5-diamino-4,8-dihydroxy-anthraquinone,
brominated 1,5-diamino-4,8-dihydroxy-anthraquinone,
1-amino-2-phenoxy-4-hydroxy-anthraquinone,
3-hydroxyquinophthalone,
1-aminoazobenzene→phenol,
2-hydroxy-5-methyl-4'-acetylamino-phenyl-azobenzene,
5-butyrylamino-isothiazolanthrone,
1,4-diisopropylaminoanthraquinone, and
1,5-diisopropylaminoanthraquinone.

2. A process according to claim 1 wherein the sublimable dyestuff is a member selected from the group consisting of 1,4-dimethylamino-anthraquinone,
chlorinated 1,5-diamino-4,8-dihydroxy-anthraquinone,
brominated 1,5-diamino-4,8-dihydroxy-anthraquinone,
1-amino-2-phenoxy-4-hydroxy-anthraquinone,
1,4-diisopropylaminoanthraquinone, and
1,5-diisopropylaminoanthraquinone.

3. A process according to claim 1 wherein the sublimable dyestuff is 3-hydroxyquinophthalone.

4. A process according to claim 1 wherein transfer printing is effected at 200°–210° C.

5. A process according to claim 1 wherein the textile material is a cotton/polyester or a cotton/polyamide mixture.

6. A process according to claim 1 wherein the textile material is a woven fabric.

* * * * *